United States Patent [19]

Winter, IV

[11] Patent Number: 4,982,541

[45] Date of Patent: Jan. 8, 1991

[54] SHINGLE OR SHAKE PANEL

[76] Inventor: Amos G. Winter, IV, Pinnacle Springs Rd., Spofford, N.H. 03462

[21] Appl. No.: 408,286

[22] Filed: Sep. 18, 1989

[51] Int. Cl.[5] ..... E04D 1/28; E04B 1/70

[52] U.S. Cl. ..... 52/303; 52/553

[58] Field of Search ..... 52/551, 560, 552, 533, 52/553, 303, 305, 478, 547, 301, 535, 302, 540, 518, 747, 748; 98/37

[56] References Cited

U.S. PATENT DOCUMENTS

| | | | |
|---|---|---|---|
| Re. 24,246 | 12/1956 | Fink | 52/553 |
| 122,935 | 1/1872 | Castor | 52/553 |
| 685,102 | 10/1901 | Chrestien | 52/553 |
| 2,148,167 | 2/1939 | Lyman | 52/478 |
| 2,276,170 | 3/1942 | Elmendorf | 52/551 |
| 2,735,143 | 2/1956 | Kearns | 52/553 |
| 2,740,166 | 4/1956 | Siering | 52/553 |
| 2,928,143 | 3/1960 | Newton | 52/553 |
| 3,004,483 | 10/1961 | Prager | 52/303 |
| 3,228,164 | 1/1966 | Ettore | 52/302 |
| 4,586,309 | 5/1986 | Ferguson | 52/553 |

FOREIGN PATENT DOCUMENTS

| | | | |
|---|---|---|---|
| 251824 | 9/1948 | Switzerland | 52/553 |

*Primary Examiner*—John E. Murtagh

*Attorney, Agent, or Firm*—George W. Dishong

[57] ABSTRACT

The present invention, in its most simple embodiment, is directed to an improved shingle or shake which has a strapping member affixed to the underside thereof and positioned across the narrow dimension of the shingle a distance from the tip end toward the butt end about equal to the exposure width. The strapping member may have at least one slot through the outer surface directed along the height dimension, substantially perpendicular to the lower facing surface and having a depth less than the strapping depth. The strapping member serves, at least, the functions of consistently positioning shingle in successive courses to result in a constant exposure width and allowing the circulation and flow of air under and around the shingles so that they will dry out and thus remain functional for a long period of time. Additionally a cover for the tip end of the shingle having vents therein provides for a uniform surface which is placed in abuting contact with the downward facing surface of the strapping member and keeps the shingle tip end from contacting the roof boards upon which the shingle may be laid. The vents further enhance the flow of drying air. In a more preferred embodiment, the strapping member, having a plurality of slots, is attached to the underside of a plurality of shingles or shakes thereby resulting in a shingle or shake panel which may then be applied to a roof or a sidewall as a shingle panel. The strapping member and a panel tip end cover perform substantial the same functions as for the shingle above but also allows for the more rapid and accurate installation of the shingles onto the roof or sidewall.

6 Claims, 1 Drawing Sheet

SHINGLE OR SHAKE PANEL

BACKGROUND OF THE INVENTION

1. Field of the Invention

This invention relates to wood shingles and to wood shakes which may be used on the roof or as siding for a building structure. More particularly, the invention relates to wood shingles and to wood shakes which may be assembled to form shingle panels which may be used on the roof or as siding for a building structure. Even more particularly this invention relates to improved shingle and/or shake panels prefabricated with a plurality of shingles or shakes attached to a strapping member transverse to the length of the shingles which member is positioned on the underside of the shingles and positioned from the tip end toward the butt end of the shingles a distance which is substantially equal to the exposure width of the shingles as applied to a roof or a sidewall of a structure.

For the purpose of the present invention the designation "shingle" is used in its generic sense to mean a small thin piece of building material of wood or other substance which usually is tapered from butt to tip, but may be of uniform thickness, and which may be machine sawn, or split on both sides, or have one side sawn and its other side split.

2. Description of the Prior Art

The rising cost of labor and materials have made building construction and especially the construction of homes increasingly more expensive. In addition the cost of heating and cooling a building has increased many times over in recent years. In order to keep the costs of construction, heating, cooling and maintenance within reasonable limits and therefore affordable to the general public, innovations have been necessary. By prefabricating and precutting many of the components of the structure at a manufacturing facility, many procedures may be used to improve the fabrication efficiency and improve the quality of the components as well as reduce the construction time.

Applying shingles or shakes to a roof or to a sidewall individually is a tedious process and requires considerable skill, dexterity and judgement to select shingles or shakes of appropriate width from a selection of random width shingles or shakes in order to break the joints appropriately between the shingles or shakes in successive courses. In order to insure a weathertight roof, the joints in any three successive courses must be offset. The width of such offset may vary but should be at least about 1 inch. Also, the space between the shingles at each joint must range between about $\frac{1}{8}$ and $\frac{3}{8}$ inches to allow for the expansion and the contraction of shingles under varying weather conditions.

There has been efforts made toward reducing the time and the skill level needed for the installation of shingles on the roof or on the sidewall of a dwelling or other builiding structure. However, all of the efforts fall short of providing for a roof or sidewall covering of shingles which is relativelyeasy and fast to apply and which provides a roof or sidewall which will last for a long period of time because there is adequate ventilation of the shingle surface and there provision for proper and adequate water drainage thus allowing the shingles to dry out. The U.S. Patents discussed hereinbelow are illustrative of such efforts. They all fail in one wayu or another to provide for ther features and the advantages of the instant invention.

U.S. Pat. No. 685,102 to Chrestien provides for a corrugated metal strip to be attached between the shingles for air circulation purposes, It should be noted however that Chrestien teaches the use of metal corrugated strips which are attached to the separate shingles when they have been put on the roof as a course of shingles. According to the figures of the Chrestien patent, air cannot easily, if at all, flow from the butt of a course to the tip end of a course above because the tip end of the shingle is touching the roof boards. Further, the shingles are not prior attached to form shingle panels and the strip is not used for purposes of aligning subsequent courses of shingles so as to enssure that the portion of the shingle which is to the weather, i.e., the exposure width, is constant. Also, of significance is the face that water drainage is not readily accomodated because of the tip end contact with the roof boards.

U.S. Pat. Nos. 4,102,107 and 4,050,209 both to Barker and U.S. Pat. No. 4,782,639 to Ferguson disclose shingles attached to an elongated strip to facilitate positioning of the shingles on a roof. In Ferguson the "integrating strips" are held in place so that it can be easily removed from the shingle strip after the shingle strip is attached to the roof. The alignment of shingle course to subsequent shingle course is done by using the butt end of the shingle rather than the taperede end or tip end. The shingles are placed subbstantially flat onto the roof boards so there is no spacing provided for drying air flow. The Barker patents teach a backing board which is of such a width that the boards are in edge to edge contact between courses and thus there is no provision for drying air flow. The Barker backing board is used for alignment purposes and becomes a part of the roof system.

U.S. Pat. No. 3,664,081 to Martin et al is similar to the Barker patent except for the strip 15 which is the kernal of the Martin et al invention. This strip 15 is used in combination with the sheathing or base strip 11. In all of the embodiments illustrated by Martin et al there is no provision for air flow and water drainage that would appear to be effective to exyend the life of the shingles.

U.S. Pat. No. 2,636,226 to Holland is directed to bevel siding. However, it is worth notin the use of two ribs 12 and 14 which combine to provide the bevel of the siding boards when such boards are used to side a building. The primary spacing and pitch however is attained by way of the vertical batten.

U.S. Pat. No. 4,586,309 to Ferguson discloses and teaches a shingle panel which comprises two courses—a shorter and a longer shingle one on top of the otheer. On the underside of the longer shingle is a strip or cleat against which the tips of an under course shingle panel rest. This cleat serves to align the courses. Here again the tip end of the undercourse shingles of the shingle panel appear to rest against the roof boards and thus not allowing for the flow of drying air or the drainage of moisture which may collect between the shingle and the roof boards.

There is no teaching in the prior art of providing for the combination of; drying air flow, shingle course alignment and water drainage all achieved primarily through the use of a properly position strapping member on the underneath surface of a series of shingles or shakes positioned next to each other and mounted with the tip ends in horizontal alignment.

It is a well-known fact with almost all roofs where shingles are used that the character of such shingles is what is known in the trade as "sawed" or "sawn" shingles, which, when laid in courses, are brought very coosely together, so much so that air is not permitted to pass freely between the different courses of shingles, which shingles will last very much longer if arrangements are provided for permitting air-spaces between the different courses of shingles. In the past when roofs had shingles put on, strapping was attached directly to and perpendicular to the roof rafters. The shingles were then nailed to the strapping. Thus, there was adequate and in fact extensive ventilation provided to the shingles. This ventilation permitted the shingles to dry out very quickly and thereby extending the lifetime measurably. In present building construction, a skin or covering is placed over the roof rafters and shingles are attached to the skin. When the shingles get soaking wet they do not dry out because they are laid directly onto the roof skin. Even when tar paper or felt paper is placed over the roof skin and the shingles placed on the felt paper, the shingles do not dry. If fact, they tend to remain wet for an even longer period of time. Shingles which cannot dry tend to deteriorate or rot. The panels of the present invention overcome the many disadvantages of the prior art shingles and shingle panels and provide for adequate ventilation and drainage.

SUMMARY OF THE INVENTION

It is and object of the present invention to provide a shingle or shake which when used on a roof or sidewall will provide ventilation and drainage and which can be laid quickly and accurately on a roof or applied to a sidewall by a person who is not necessarily a skilled shingler and will provide an attractive, enduring weathertight structure.

A further object is to provide a shingle panel which is made up of a plurality of shingles and which can be manufactured easily and quickly and easily packaged and shipped from a manufacturing plant to the construction site where the panels can be laid quickly and accurately, maintaining proper exposure widths and non-alignment of cracks, on a roof or applied to a sidewall by a person who is not necessarily a skilled shingler a nd will provide an attractive, enduring weathertight structure.

Another object is to provide a wood shingle panel which can be used on a roof or sidewall and the apearance of which is indistinguishable from that of a roof or sidewall made using individual shingles.

Yet another object is to provide a shingle and/or a shingle panel which when used with other similar panels for laying on a roof or sidewall there is adequate ventilation and drainage so that the shingles remain functional and attractive in appearance for an extended period of time.

The present invention, in its most simple embodiment, is directed to an improved shingle or shake which has a strapping member affixed to the underside thereof and positioned across the narrow dimension of the shingle a distance from the tip end toward the butt end about equal to the exposure width and which serves, at least, the functions of consistently positioning shingle in successive courses to result in a constant exposure width and allowing the circulation and flow of air under and around the shingles so that they will dryv out and thus rema functional for a longer period of time.

In a more preferred embodiment, the strapping member is attached to the underside of a plurality of shingles or shakesz thereby resulting in a shingle or shake panel which may then be applied to a roof or a sidewall as a shingle panel. The strapping member also acts to permit airflow or ventilation from end to end across of the roof surface upon which the shingle panel is placed because the strapping member keeps the underside of the shingle from contacting the roof boards. Cutting a notch or a plurality of notches in the direction of the small dimension of the strapping, i.e., in the direction of the longer dimension of each of the single shingles, would prmoit ventilation of the roof, by the so-called chimney effect, in a direction from the lower edge to the ridge or top of the roof and would also permit drainage of water which may collect between the underside of the shingles and the surface of the roof boards.

It is a primary object of the invention to provide a shingle comprising: a tip end; a butt end at an end opposite from said tip end; a strapping member having an inner surface, an outer surface opposite the inner surface and a lowr facing surface, the strapping member attached to an underside of the shingle with the inner surface and the underside in contact and the lower facing surface parallel to said tip end and substantially perpendicular to the underside and positioned from the tip end toward the butt end by a distance amount substantially equal to a shingle exposure wideth and the stapping member having a length about equal to the shingle width, a depth of at least about ¼ inch, and a height of typically about 1 inch but less than the shingle exposure width. The strapping member may have at least one slot through the outer surface directed along the height dimension, substantially perpendicular to the lower facing surface and having a depth less than the strapping depth.

A further object of the present invention is to provide the shingle further comprising a tip end cover removably attached to the tip end and wherein the tip end cover may have at least one vent substantially perpendicular to the tip end.

A yet further object of the present invention is to provide a shingle panel comprising: a plurality of shingles affixed in edge-to-edge relationship to a strapping member thereby forming the shingle panel, the strapping member having an inner surface, an outer surface opposite the inner surface and a lower facing surface, the strapping member attached to an underside of each of the shingles with the inner surface and the shingle underside in contact and the lower facing surface parallel to a panel tip end and substantially perpendicular to the underside and positioned from the panel tip end toward a panel butt end by a distance amount substantially equal to a shingle panel exposure width and the strapping member having a length about equal to the shingle panel length, a depth of at least about ¼ inch, and a height less than the shingle panel exposure width. The strapping member may have at least one slot through the outer surface directed along the height dimension, substantially perpendicular to the lower facing surface and having a depth less than the strapping depth.

A further object of the present invention is to provide the shingle panel further comprising a tip end cover removably attached to the panel tip end and wherein the tip end cover may have at least one vent substantially perpendicular to the panel tip end.

These and further objects of the present invention will become apparant to those skilled in the art after a study of the present disclosure of the invention.

DESCRIPTION OF THE PREFERRED EMBODIMENTS

Figure 1:
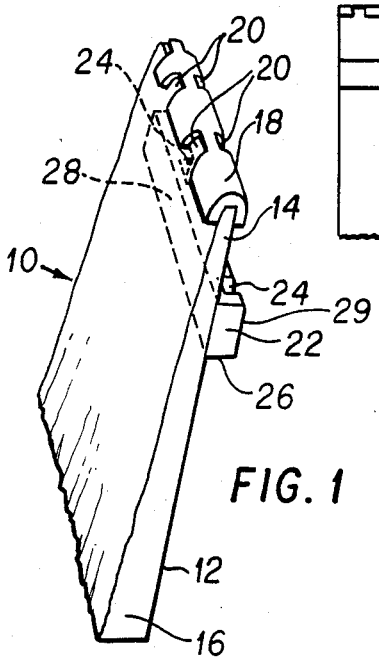
FIG. 1 is a top perspective view of the wood shingle having a tip end cover with vents and a strapping member with slots according to the present invention.

In order to more clearly describe and disclose the invention, the shingle or shakes will be collectively referred to as shingles. Thus shingles herein will include those pieces which are split on both sides or on one side or where both sides are sawn. In the detailed description, the use of the shingles and the shingle panels will be essentially limited to a description of the use of the shingles and panels as the material to make a roof of a building structure weathertight. It is understood that the shingles and the shingle panels of the invention could be used with the same advantage, as a material for siding a house or other building structure.

It is also important to note that the length of the shingle panels may vary. It may be desirable to have shingle panels with a standard length such as for example nominally four (4) feet but clearly the length of the shingle panel may be as long as one may wish only limited by the size one can conveniently and safely handle on the roof.

It may also be desirable to have each shingle of the plurality of shingles which make up the shingle panel have a rondom width so that when the panels are laid onto the roof boards there is not a monotony to the pattern of the width of the butt end exposure.

It should also be clearly noted that it is not the intent to teach how shingle panels may be applied to the roof or to the sides of a building structure. Those having ordinary skill in the art of roofing using shingles and/or shakes are well aware of the methods and the advantages of various methods for the use of such shingles and shakes. Nevertheless, it is noted that the shingle panels of the invention may be applied so that there is double thickness, that is to say that two shingle thickness exists where the panels overlap or triple thickness. The method involving application to obtain double thickness is illustrated in the drawing figures which illustrate that the exposure or the weather portion of the shingle is about equal to one-half the shingle length (preferably a small amount less than one-half the shingle length). Such an application allows for double shingle thickness and covering of the nails used to attch the shingle panels to the roof. For triple thicknes application, the exposure or the weather portion of the shingle is about equal to one-third the shingle length (preferably a small amount less than one-third the shingle length). Such an application allows for triple shingle thickness and covering of the nails used to attach the shingle panels to the roof. Additionally, the nails used to attach the shingle panels to the roof or side of the building go throughj two shingle thicknesses and through oen strapping member. In the double thickness method it is preferable to place material such as felt paper or the like between the shingle layers in the area where the shingle panel overlap occurs. In the triple thickness method such felt paper does not provide significant additional advantage.

It is also well known that in order to maintain a desired offset (the spacing that exists between the joints of successive courses) such as one, one and one-half or more inches, the shingles which are assembled into shingle panels should have widths which in increments that equal about twice the desired amount of offset. For example, if the offset is to be maintained at at least one and one-half inches then the shingle widths should preferably be in increments of three inches. The shingles of predetermined but repetitious unequal widths should be arranged in an established series in all the panels. Lengthwise offsetting the panels in successive adjacent courses will serve to stagger the cracks between the shingle in successive courses and so maintain the desired offset.

These many variations to the method of application, the size and the appearance of the shingle panel are within the scope of the instant invention but in order to more clearly and simply disclose the novel features and characteristics of the instant invention, these variations will not be elaborated upon. Instead emphasis is placed on the essence of the invention; the tip end cover and the strapping member and the advantages provided by them.

Figure 4:
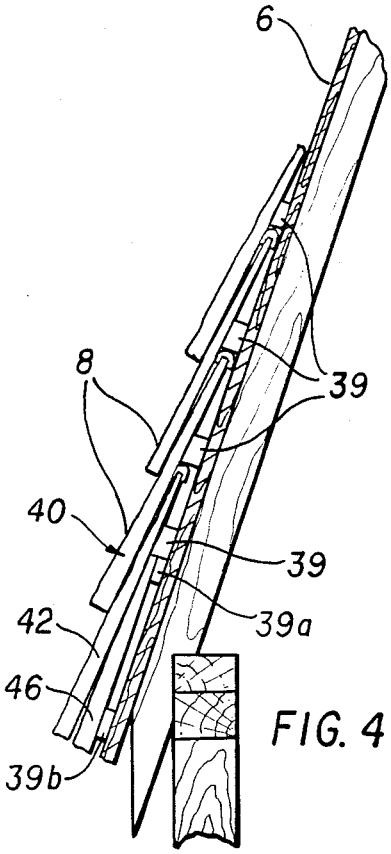
FIG. 4 is an end view illustrating four courses including the starter course of shingle panels.

Referring now to the embodiment shown in FIG. 1 which illustrates a shingle 10 with a sawn underside 12 and a split outer surface. The strapping member 22 is attached to the underside 12 of shingle 10 so that the downward facing surface 26 of member 22 is parallel to and a distance downward from the tip end 14 towared the butt end 16 equal to the amount of exposure width that is intended when the shingles 10 are laid, by conventional methods such as nailing, onto roof boards 6 (see FIG. 4). Slots 24 may be cut into member 22 to allow for improved ventilation from the bottom fo the roof to the ridge or top of the roof. Water drainage is also improved with the incorporation of the slots 24. A tip end cover 18, which may be may of wood, plastic, metal or any other suitable material, is placed over the shingle tip end 14. Cover 18 may have vents 20 cut into the cover 18 which furthr enhances airflow and water drainage. Additionally, cover 18 keeps the tip end 14 from contacting the roof boards 6 thus water will not soak into the shingle 10 through tip ends 14. Another advantageof the tip end cover 18 is that it provides a smooth straight surface against which will rest the downward facing surface 26 of member 22 on a similar shingle 10 which is in the shingle course above and disposed in the overlapping relationship of a conventional roof or side wall. Shingle 10 may have varying widths and when individual shingles according to the present invention are use for roofing, care must be taken to select shingles 10 which have widths so that the cracks between shingles in successive courses or rows are not in registration. That is, the cracks must be adequately offset to assure a weathertight roof.

Figure 2:
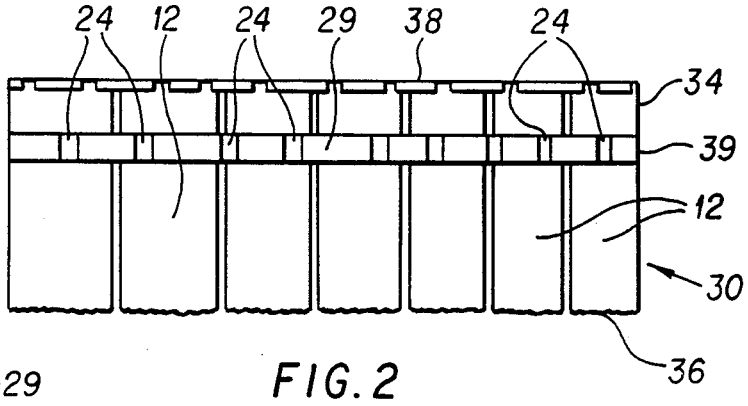
FIG. 2 is a rear plan view of the wood shingle panel showing a plurality of shingles in side-by-side relationship attached to a strapping member having slots therethrough according to the present invention.

The embodiment shown by FIG. 2 is a shingle panel 30 which is basically a plurality of shingles 10 attached with the shingle underside 12 in contact with the inner surface 28 of strapping member 22 and the length of shingle 10 extends transversely of the length of strapping 39. The shingles 10 are attached side-by-side in coplanar relationship with the tip ends 14 in substantial alignment to form a shingle panel tip end 34 and a shingle panel butt end 36. A panel tip end cover 38 having a plurality of vents 20 may be placed on the panel tip end 34 at the manufacturing plant prior to shipping or it may be put on the panel 30 at the construction site. The tip end cover 38 over the panel tip end 34 makes inconsequential all of the small non-uniformities of the shingle tip ends 14 including any misalignment of the tip ends 14 of the panels 10 affixed to member 39.

The panel tip end cover 38 may be in long sections and cut or broken to the proper length, equal to the length of the panel 30. Cutting or breaking is facilitated by the vents 20. The shingles 10 are held or maintained in relationship because they are affixed because they are affixed using staples, glue, nails or other appropriate means to the strapping member 39 which length is about equal to the length of panel 30.

Figure 3:
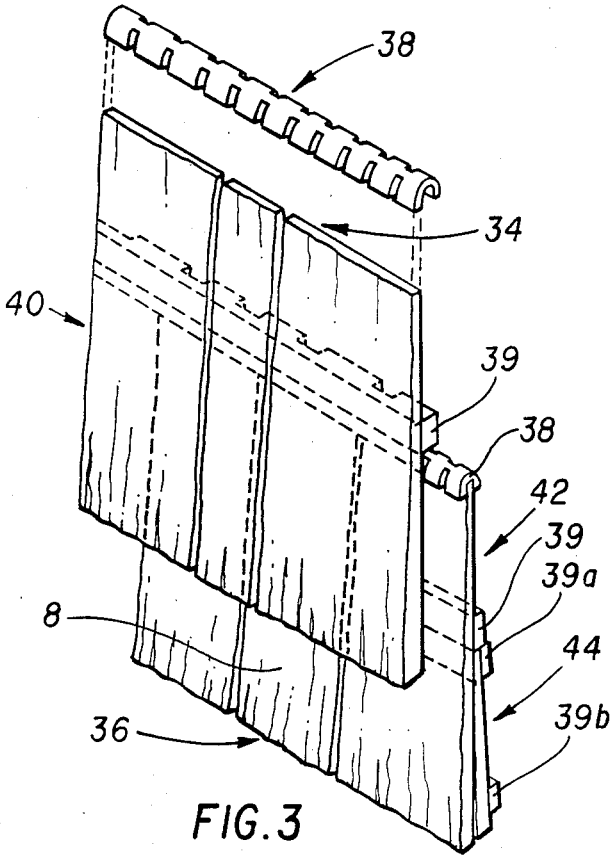
FIG. 3 is top perspective showing a portion of two courses of shingle panels and illustrating the tip end cover with vents and the strapping member with slots and showing the overlapping relationship, the shingle panel alignment and the exposure surface.

In FIG. 3 there is illustrated a starter course 44 and two further courses 42 and 40. The panel tip end cover 38 is shown not position onto the panel tip end 34 in order to illustrate that the cover 38 can be placed onto the shingle panel 30 just prior to laying the shingle onto the roof. Any roof will be started with a starter course 44 which starter course panels 46 differs from the regular shingle panel 30 in that there is a lower and an upper strapping member **39*b* and 39*a* respectively. The distance from the butt end of the starter course panel 46 to the top end of starter course panel 46 is equal to the length of shingle 10 less the exposure surface 8 height. The exposure surface height being the nominal distance from butt end 16 of one course of shingles 10 or the panel butt end 36 of shingle panels 30 to the butt end 16 of the shingles 10 or panel butt end 36 of shingle panels 30 of the next course as for example courses 42 and 40 of FIGS. 3 and 4**.

The exposure surface 8 height will typically be from about 30% to about 45% of the length of a shingle 10 or the height of shingle panel 30. Where the exposure is less than ⅓ or 33% of the height there will be three layers of shingle and a roof made in such a manner will be very weathertight. In order to better facilitate the attachment, typically by nailing to the roof or the side of the building, a nail line marking, made by scribing or otherwise, may be placed on the split outer surface at a location which would be about twice the exposure surface 8 height less about ½ the height dimension of strapping member 39 as measured from the panel tip end 34. Where the exposure is greater than ⅓ or 33% and less than 50% there will be areas of the shingles roof which will have a thickness of only two layers. It may be advisable in such a situation to put a layer of felt paper between the overlapping portion of successive courses of shingles. A nail line marking is of no advantage when the exposure surface 8 height approaches about one-half the height of shingle panel 30. In such a situation each panel 30 is nailed directly to the roof. That is to say that the nails do not go through two thicknesses of shingle and thus the strapping member 39, through which the nail is driven, is visible during the nailing of the panel 30 to the roof.

It is thought that the shingles and the shingle panels of the present invention and many of the attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A shingle comprising: a tip end; a butt end at an end opposite from said tip end; a strapping member having an inner surface, an outer surface opposite said inner surface and a lower facing surface, said strapping member attached to an underside of said shingle with said inner surface and said underside in contact and said lower facing surface parallel to said tip end and substantially perpendicular to said underside and positioned from said tip end toward said butt end by a distance amount substantially equal to a shingle exposure width and said strapping member having a length about equal to the shingle width, a depth of at least about ¼ inch, and a height less than said shingle exposure width and wherein said strapping member has at least one slot through said outer surface directed along said height dimension, substantially perpendicular to said lower facing surface and having a depth less than said strapping depth.

2. The shingle according to claim 1 further comprising a tip end cover removably attached to said tip end.

3. The shingle according to claim 2 wherein said tip end cover has at least one vent substantially perpendicular to said tip end.

4. A shingle panel comprising: a plurality of shingles affixed in edge-to-edge relationship to a strapping member thereby forming said shingle panel, said strapping member having an inner surface, an outer surface opposite said surface and a lower facing surface, said strapping member attached to an underside of each of said shingles with said inner surface and said shingle underside in contact and said lower facing surface parallel to a panel tip end and substantially perpendicular to said underside and positioned from said panel tip end toward a panel butt end by a distance amount substantially equal to a shingle panel exposure width and said strapping member having a length about equal to the shingle panel length, a depth of at least about ¼ inch, and a height less than said shingle panel exposure width and wherein said strapping member has at least one slot through said outer surface directed along said height dimension, substantially perpendicular to said lower facing surface and having a depth less than said strapping depth.

5. The shingle panel according to claim 4 further comprising a panel tip end cover removably attached to said panel tip end.

6. The shingle panel according to claim 5 wherein said panel tip end cover has at least one vent substantially perpendicular to said panel tip end.

* * * * *